United States Patent [19]

Hermansson

[11] Patent Number: 4,842,200

[45] Date of Patent: Jun. 27, 1989

[54] PIVOTABLE NOZZLE

[75] Inventor: Klas G. I. Hermansson, Tyringe, Sweden

[73] Assignee: Dinol International Aktiebolag, Hassleholm, Sweden

[21] Appl. No.: 244,474

[22] Filed: Sep. 14, 1988

[30] Foreign Application Priority Data

Sep. 16, 1987 [SE] Sweden ..... 8703578

[51] Int. Cl.[4] ..... B05B 3/02; F04B 19/02; F04B 29/00

[52] U.S. Cl. ..... 239/263; 239/264; 239/752; 92/116; 92/118; 417/461

[58] Field of Search ..... 239/DIG. 13, 227, 263, 239/264, 750, 752; 417/460, 461; 74/99 A; 92/116, 118, 119, 161, 146, 261

[56] References Cited

U.S. PATENT DOCUMENTS 4,535,846 8/1985 Gagliardo et al. ..... 239/507

*Primary Examiner*—Andres Kashnikow
*Assistant Examiner*—Christopher G. Trainor
*Attorney, Agent, or Firm*—Burns, Doane, Swecker & Mathis

[57] ABSTRACT

The present invention relates to a pivotable spraying nozzle intended to be used in the treatment of a chassis for a car body. The device comprises a nozzle and a feeding tube for a chassis treatment agent. The nozzle is supported in a hydraulic/pneumatic cylinder piston rod. The piston rod being provided with a roller at its rear end. A cylinder in which the piston rod is movably arranged, is provided with an angular plate at its rear end which cylinder is eccentrically rotatably mounted to said angular plate.

4 Claims, 1 Drawing Sheet

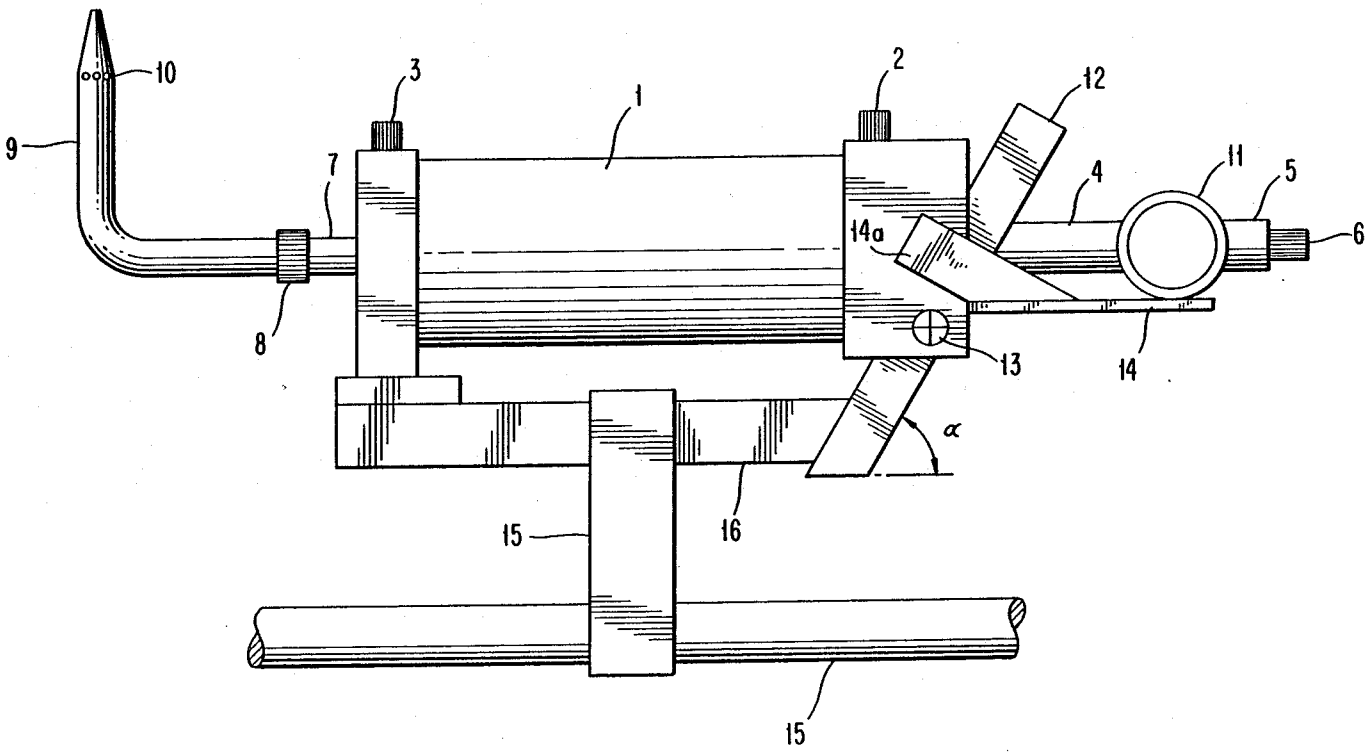
6
5
11
12
4
14
13
2
14a
α
1
3
7
8
10
9
16
15
15

PIVOTABLE NOZZLE

TECHNICAL FIELD

The present invention relates to a pivotable nozzle intended to be used in the treatment of chassis of motor vehicles, and comprising a nozzle and a feeding tube for the chassis treatment agent.

The object of the present invention is to obtain a rotatable nozzle to be used in the treatment of chassis of motor vehicles, whereby the nozzle can be rotated in to the opening through which the chassis treatment agent, such as a rust preventing agent, is to be introduced, and to be brought out of position after spraying is finished, in order to allow moving of the vehicle, and to prevent the clogging of the nozzle by rust protecting agent dripping on to it.

BACKGROUND OF THE INVENTION

In the treatment of chassis of motor vehicles, such as on a production line, a rust protecting agent is introduced through a number of holes and openings provided in the chassis and the car the body to protect spaces in beams and body against corrosion. Hereby a series of nozzles is brought from a carrier/platform up to its respective hole where a spraying takes place. Very often these holes are arranged vertically above the nozzles, which means that these only need to be forwarded vertically upwardly from the carrier, but in certain cases these holes are placed in such a way that the nozzle has to be pivoted in to its place. After spraying is finished, an after drip will occur from said hole, whereby, in the case a nozzle is placed straight underneath the hole, the rust protecting agent will fall down onto the nozzle and may thereby clog the same, particularly if some time period occurs before the nozzle is used again.

There is thus a need for a pivotable spraying nozzle which can be brought into position to a hole being hard to access, and can be brought out of position after spraying is finished in order to eliminate fouling thereof.

DESCRIPTION OF THE PRESENT INVENTION

It has now surprisingly been shown possible to be able to fulfil this need by means of the present invention which is characterized in that the nozzle is arranged on a hydraulic/pneumatic cylinder piston rod, that said piston rod is provided with a roller at its rear end, and that the cylinder is provided with an angular plate in its rear end which plate is intended to be brought into contact with said roller, the cylinder being eccentrically rotatably mounted on said angular plate to obtain a lever between the contacting point of said roller with the angular plate and said excentric mounting point.

Further characteristics are evident from the accompanying claims.

The present invention be described more in detail in the following with reference to the accompanying drawing, the only figure of which shows a preferred embodiment of the invention seen from the side. It shall be understood that the invention is not restricted to this embodiment but can be varied within the scope of the accompanying claims.

1 denotes a cylinder provided with a piston arranged to be brought forward and rearward, said cylinder 1 being provided with a connector 2 for the introduction of a working medium, such as air or oil, and a connector 3 for the evacuation of such a medium at the forward movement of the cylinder piston (to the left in the drawing) and vice versa at the return (to the right in the drawing). The piston (not shown) of the cylinder 1 is provided with a tubular piston rod 4, which, at its rear end 5, is provided with a connector 6 for a connection to a pressurized source of rust protecting agent, and at its front end 7, the rod 4 is provided with a connector 8 to attach a spraying nozzle 9 provided with a nozzle hole 10. In the rear end 5 of the piston rod there is further a roller 11 arranged. Hereby the roller 11 is rotatably mounted on a bearing arranged on a shaft (not indicated as such), which shaft is arranged perpendicular to the piston rod 4. On the cylinder 1 there is an angular plate 12 arranged so that the cylinder 1 can turn around this angular plate 12 via a mounting point 13 in the form of a shaft. The mounting point 13 is hereby eccentrically arranged with regard to the longitudinal axis of the cylinder 1. A guiding plane 14 is also fixedly arranged on the rear end of the cylinder 1 via support arms **14*a*, against which guiding plane 14 the roller 11 is arranged to roll and be supported with the intention to prevent the rotation of the piston rod and thereby a rotation of the nozzle. The angular plate 12 is in the present embodiment also the attachment point of the cylinder 1 to a stand 15 via a carrier 16 the position of which can be adjusted vis-a-vis the stand 15. The angular plate 12 is hereby fixedly attached to the carrier 16. The front end of the cylinder 1 hereby rests against a resting plate arranged on the carrier 16. The stand 15 and the carrier 16** are mounted to rack or frame of any type.

The angular plate 12 has an angle of inclination towards the longitudinal axis of the cylinder 1 which is normally 45°–70°. The greater the angle is the greater force is needed to turn the cylinder 1 which will be evident from below.

In the operation of the present spraying nozzle a nozzle 9 is connected to the front end 7 via the connector 8 of the piston rod 4, and the rear end 5,6 of the piston rod 4 is connected to the pressurized rust protecting agent. If so desired, compressed air is fed, either manually, or mechanically via a computerized controlling system, into the cylinder 1 through the connector 2, whereby the cylinder piston and the piston rod 4 will move forwardly. The roller 11 hereby moves along the guiding plane 14. The roller 11 finally reaches the angular plate 12 and the piston rod 4 is now no longer able to move forwardly. Due to the fact that a lever is present between the attachment point of the roller 11 against the angular plate 12 and the eccentric bearing 13 the roller 11 will strive down along the angular plate 12 in order to minimize this lever, and thereby turn the cylinder 1 upwardly, either as long as the piston rod 4 is pressed forwardly in the cylinder, or until the cylinder 1 abuts a stop, such as the upper part of the angular plate 12 with its rear end. The spraying nozzle 9 with its nozzle holes 10 is now in place and spraying can be carried out. After finished spraying the piston is brought rearwardly by means of compressed air being introduced via the connector 3, the roller 11 now moves upwardly along the angular plate 12 and the cylinder turns back downwardly to its starting position, simultaneously as the piston rod 4 with its nozzle 9 moves back and away from a position underneath the hole which it has been brought in contact with, whereby any drips from this hole will not reach the nozzle or the parts belonging thereto.

The position of the cylinder 1 has, in the present figure, been shown as a horizontal one, but its longitudinal axis can of course have any angle to the horizontal plane.

Above it has been stated that the angular plate 12 can take different angles to the longitudinal axis of the cylinder 1 in the resting position. If one desires a large pivoting with a small forward movement of the piston/piston rod 4 the angle is increased, while when one desires a longer movement of the piston rod with a less pivoting action the angle is decreased.

It shall also be understood that the spraying nozzle need not be an integrated part of the piston rod but can be attached to the piston rod 4 outside the longitudinal axis of the cylinder 1 if so, requested due to for example, limited operating space.

I claim:

1. A pivotable spraying nozzle intended to be used for treating a chassis of a car body comprising a nozzle and a feeding tube for a chassis treatment agent characterized in that the nozzle is supported on a front end of a hydraulic/pneumatic piston rod which extends through and is movably arranged within a cylinder said piston rod being provided with a roller at its rear end, said cylinder having a rear end eccentrically rotably attached to an angular plate and wherein upon forward movement of the piston rod, the roller is brought into contact with the angular plate thereby causing the cylinder to rotate about its eccentric attachment.

2. The spraying nozzle of claim 1 wherein the angular plate has angle with respect to the longitudinal axis of the cylinder in the range of 45° to 70° in the starting position.

3. The spraying nozzle of claim 2 wherein the piston rod is tubular and serves as a feeding tube for the treatment agent supplied to the nozzle.

4. The spraying nozzle of claim 1 wherein the piston rod is tubular and serves as a feeding tube for the treatment agent supplied to the nozzle.

* * * * *